US006170266B1

(12) United States Patent
Pidcock et al.

(10) Patent No.: US 6,170,266 B1
(45) Date of Patent: Jan. 9, 2001

(54) COMBUSTION APPARATUS

(75) Inventors: Anthony Pidcock; Desmond Close; Michael P Spooner, all of Derby (GB)

(73) Assignee: Rolls-Royce plc, London (GB)

( * ) Notice: Under 35 U.S.C. 154(b), the term of this patent shall be extended for 0 days.

(21) Appl. No.: 09/245,414

(22) Filed: Feb. 5, 1999

(30) Foreign Application Priority Data

Feb. 18, 1998 (GB) ..... 9803291

(51) Int. Cl.[7] ..... F02G 3/00
(52) U.S. Cl. ..... 60/755
(58) Field of Search ..... 60/752, 753, 755, 60/756, 757

(56) References Cited

U.S. PATENT DOCUMENTS 4,653,279 * 3/1987 Reynolds ..... 60/757
4,695,247 * 9/1987 Ensaki et al. ..... 431/352

FOREIGN PATENT DOCUMENTS 2173891 10/1986 (GB) .

* cited by examiner

*Primary Examiner*—Charles G. Freay
*Assistant Examiner*—Ehud Gartenberg
(74) *Attorney, Agent, or Firm*—W. Warren Taltavull; Farkas & Manelli PLLC

(57) ABSTRACT

A double wall structure for a gas turbine engine has an inner wall comprising a number of tiles. The outer wall is provided with a number of apertures through which air is directed into the space between the two walls. Inclined apertures are provided in the tiles so that cooling air can pass into the combustion chamber and form a cooling film underneath the tile. Each tile is provided with a number of pedestals. The orientation of the inclined apertures is such that the axis of each aperture lies upon an unobstructed channel between the pedestals.

8 Claims, 2 Drawing Sheets

COMBUSTION APPARATUS

FIELD OF THE INVENTION

This invention relates to a gas turbine engine. More particularly but not exclusively this invention relates to a gas turbine engine combustor and more particularly the wall structure of a gas turbine engine combustor.

BACKGROUND OF THE INVENTION

In order to improve thrust and fuel consumption of gas turbine engines i.e. the thermal efficiency, it is necessary to use high compressor pressures and higher combustion temperatures than have conventionally been used. Higher compressor pressures give rise to higher compressor outlet temperatures and higher pressures in the combustion chamber giving rise to the combustor chamber experiencing much higher temperatures.

There is, therefore, a need to provide effective cooling of the combustion chamber walls. Various cooling methods have been proposed including the provision of a double walled combustion chamber whereby cooling air is directed into the gap between the chamber walls thus cooling the inner wall. This air is then exhausted into the combustion chamber through apertures in the inner wall. The inner wall may also comprise a number of heat resistant tiles. Constructing the inner wall from tiles has the advantage of providing a simple low cost construction. Combustion chamber walls which comprise two or more layers whilst being advantageous in that they only require a relatively small flow of air to achieve adequate cooling are prone to some problems. These include the formation of hot spots in certain areas of the combustion chamber wall and the combustion chamber. Prior art proposals to alleviate this problem include the provision of raised lands or pedestals on the cold side of the wall tiles. Reference is hereby directed to GB Patent no. 2 087 065. These lands or pedestals serve to increase the surface area of the wall element thus increasing the cooling effect of the air flow between the combustor walls. Compressor delivery air is convected through pedestals on the 'cold face' of the tile and emerges as a film directed along the 'hot' surface of the following downstream tile.

The provision of such lands is also accompanied by inherent problems. For example localised overheating may occur behind obstructions such as mixing ports or adjacent to regions where near stoichiometric combustion gives rise to high gas temperatures (hot streaks). There is no provision for enhanced heat removal, either locally to remove hot spots or to alleviate more general overheating towards the downstream end of the tile. Overheating may occur downstream of the mixing ports since the protective wall cooling film is stripped away by the transverse mixing jets. Where design requirements have dictated a relatively long tile the cooling film quality towards the downstream edge of the tile may be poor and lead to overheating.

SUMMARY OF THE INVENTION

An object of this invention is, therefore, to provide an improved wall arrangement for a combustion chamber and/or to provide improvements generally.

According to the invention there is provided a wall structure for a gas turbine engine combustor which at least in part defines a combustion chamber, the wall structure comprising at least one outer wall and one inner wall which are spaced apart to define a space therebetween, the outer wall having a means for the ingress of air into the space between the outer and inner walls, the inner wall comprising a number of wall elements, each of said wall elements having a plurality of inclined apertures defined therein to facilitate the exhaustion of air into the combustion chamber, each wall element also comprising a plurality of raised lands, the raised lands arranged in staggered rows so that the lands of adjacent rows are offset from one another, and the inclined apertures are disposed between the raised lands, the arrangement of the raised lands providing in particular directions unobstructed channels between the raised lands, and the inclined apertures being orientated such that the axes of the inclined apertures lie along the unobstructed channels between the raised lands.

According to a second aspect of the invention there is also provided a wall structure for a gas turbine engine combustor which at least in part defines a combustion chamber which has a central axis, the wall structure comprising at least one outer wall and one inner wall which are spaced apart to define a space therebetween, the outer wall having a means for the ingress of air into the space between the outer and inner walls, the inner wall comprising a number of wall elements, each of said wall elements having a plurality of inclined apertures defined therein to facilitate the exhaustion of air into the combustion chamber, each wall element also comprising a plurality of raised lands, the raised lands arranged in staggered rows so that the lands of adjacent rows are offset from one another, and the inclined apertures each of which have an axis are orientated such that the angle defined between the aperture axis and the combustion chamber axis corresponds to an angular offset of the raised lands of adjacent rows.

Preferably said lands are arranged in an array and the offset of the lands of adjacent rows is at an angle to a central axis of the combustor.

Preferably the combustor is arranged to have a general direction of fluid flow therethrough and said apertures are angled at an angle of 30° to the general direction of fluid flow within the combustion chamber.

Preferably the wall elements comprise discrete tiles. The raises lands may comprise pedestals.

Mixing parts may be provided with the combustion chamber walls to provide air into the combustion chamber.

The downstream edges of each of the wall elements may be coated with a thermal barrier coating.

BRIEF DESCRIPTION OF THE DRAWINGS

The present invention will now be described, by way of example, with reference to the accompanying drawings.

DETAILED DESCRIPTION OF THE INVENTION

Figure 1:
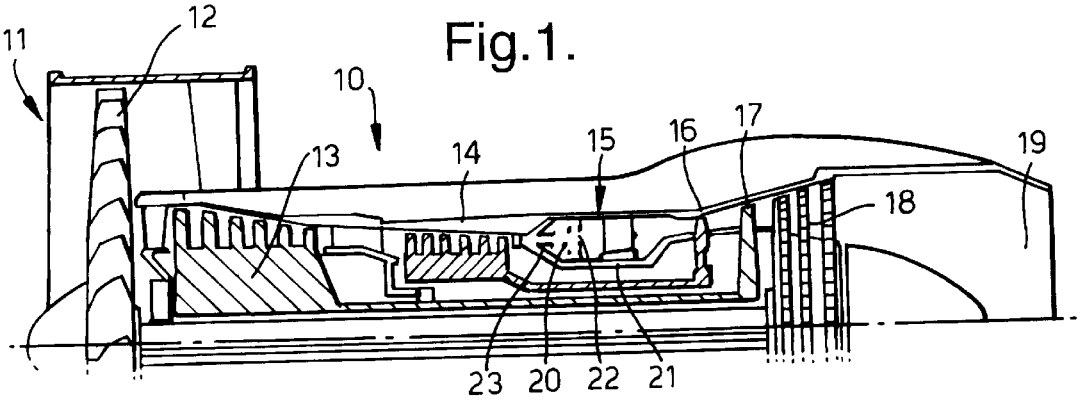
FIG. 1 is a schematic diagram of a ducted fan gas turbine engine having an annular combustor having a wall structure in accordance with the present invention.

With reference to FIG. 1 a ducted fan gas turbine engine generally indicated at 10 comprises, in axial flow series, an air intake 11, a propulsive fan 12, an intermediate pressure compressor 13 , a high pressure compressor 14, combustion equipment 15, a high pressure turbine 16, an intermediate pressure turbine 17, a low pressure turbine 18 and an exhaust nozzle 19.

The gas turbine engine 10 works in the conventional manner so that air entering the intake 11 is accelerated by the fan 12 to produce two air flows, a first air flow into the intermediate pressure compressor 13 and a second airflow which provides propulsive thrust. The intermediate pressure compressor 13 compresses the air flow directed into it before delivering the air to the high pressure compressor 14 where further compression takes place.

The compressed air exhausted from the high pressure compressor 14 is directed into the combustion equipment 15 where it is mixed with fuel and the mixture combusted. The resultant hot combustion products then expand through and thereby drive the high, intermediate, and low pressure turbines 16, 17, and 18 before being exhausted through the nozzle 19 to provide additional propulsive thrust. The high, intermediate and low pressure turbines 16, 17 and 18 respectively drive the high and intermediate pressure compressors 13 and 14 and the fan 12 by suitable interconnecting shafts.

The combustion equipment 15 comprises an annular combustor 20 having radially inner and outer wall structures 21 and 22 respectively. Fuel is directed into the combustor 20 through a number of fuel nozzles (not shown) located at the upstream end of the combustor 20. The fuel nozzles are circumferentially spaced around the engine 10 and serve to spray fuel into air derived from the high pressure compressor 14. The resultant fuel and air mixture is then combusted within the combustor 20. The combustion process which takes place within the combustor 20 naturally generates a large amount of heat. It is necessary therefore to arrange that the inner and outer walls 21,22 are capable of withstanding this heat flow while functioning in a normal manner. The radially outer wall structure 22 can be seen more clearly if reference is made to FIG. 2.

Figure 2:
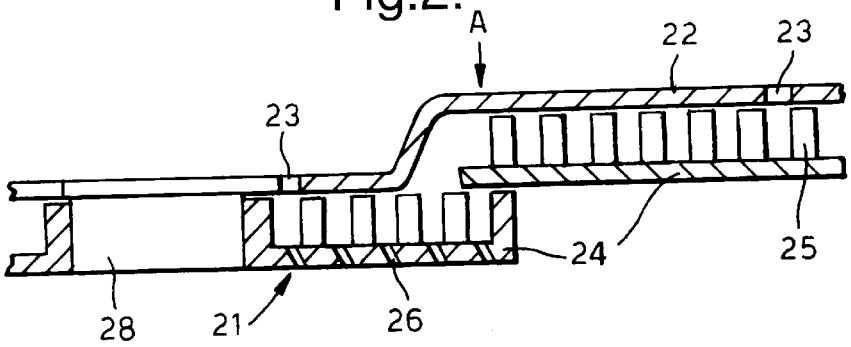
FIG. 2 is a detail close-up view of part of the combustor walls of the engine of FIG. 1.

Referring to FIG. 2 the radially inner wall structure 21 comprises a plurality of discreet tiles 24 which are all of substantially the same rectangular configuration and are positioned adjacent each other. The majority of the tiles 24 are arranged to be equidistant from the outer wall 22. Each tile 24 is of cast construction and is provided with integral studs (not shown) which facilitate its attachment to the outer wall 22.

Feed holes 23 are provided in the outer combustor wall 22 such that cooling air is allowed to flow into the gap between the tiles 24 and the outer wall 22.

Each tile 24 also has a plurality of raised lands or pedestals 25 which improve the cooling process by providing additional surface area for the cooling air to flow over.

Figure 3:
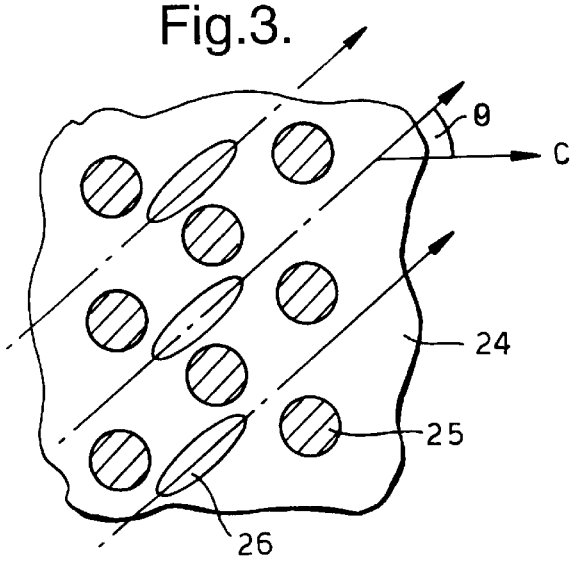
FIG. 3 is a cutaway view on arrow A of FIG. 2.

The array of pedestals 25 is staggered such that adjacent rows of pedestals 25 are offset from one another as indicated in FIG. 3. Preferably the raised lands or pedestals are staggered on an equilateral pitch. Staggering the array of pedestals 25 provides the opportunity for closer packing of the pedestals 25 on the tiles 24 whilst still providing sufficient clearance around each individual pedestal 25 to allow cooling air to flow around it. This increased packing increases the surface area for the cooling air to flow over which improves the cooling of the tile 24. A staggered array also provides a more even distribution of pedestals 25 over the tile 24 which provides a more even cooling of the tile 24.

Each tile 24 also comprises a number of effusion cooling holes 26 positioned between the pedestals 25. Since the pedestals 25 are usually on an equilateral pitch, a clear path between the pedestals 25, where the cooling holes 26 are positioned, is provided at 30° to the combustion flow path C parallel to the engine axis. The cooling holes 26, aswell as being inclined with respect to the wall surface, are angled and orientated so that an extended axis of the cooling hole 26 lies along a clear path between the pedestals 25. As shown in FIG. 3 the axes of the cooling holes 26 are therefore arranged at 30° to the combustor flow path C and combustor axis. However it is also envisaged that if the pedestals 25 are not positioned on an equilateral pitch then any clear path angle can be produced. Typically the angle θ may be between 90°, producing circumferentially directed cooling holes 26, and 0°, giving axially directed cooling holes 26.

By aligning the axes of the cooling holes 26 with a clear path between the pedestals 25, the cooling holes 26 can be easily laser machined with reduced risk of the laser beam impinging the pedestals 25 and damaging or machining the pedestals 25. Conventionally to allow machining of the cooling holes 26 some of the pedestals 25 in the path of the cooling hole axes need to be removed or modified. The results in the conventional arrangements having a reduced cooling performance and a less even distribution of pedestals 25 resulting in less even cooling of the tiles 24. The alignment and orientation of cooling holes 26 as well as making manufacture easier and allowing an improved arrangement of pedestals 25 also permits the use of cooling holes 26 with shallower inclinations to the wall. Cooling holes 26 with shallower inclination angles provide better direction of the cooling air along and over the wall surface which results in improved cooling. They also advantageously result in less disturbance of the combustor airflow by the cooling airflow.

These angled cooling holes 26 are positioned towards the rear of each tile 24 to reinforce the cooling air film exhausting from the upstream tile 24. During engine operation some of the air exhausted from the high pressure compressor 14 is permitted to flow over the exterior surface of the combustor 20. The air provides cooling of the combustor 20 and some of it is directed into the combustion chamber through the cooling holes 26 to provide a cooling film underneath each tile 24. Air is also directed into the combustion chamber through mixing ports 28. Mixing ports 28 have the sole function of directing air into the combustion chamber in a manner to achieve optimum mixing with the fuel and thus help to control all combustion emissions.

Figure 4:
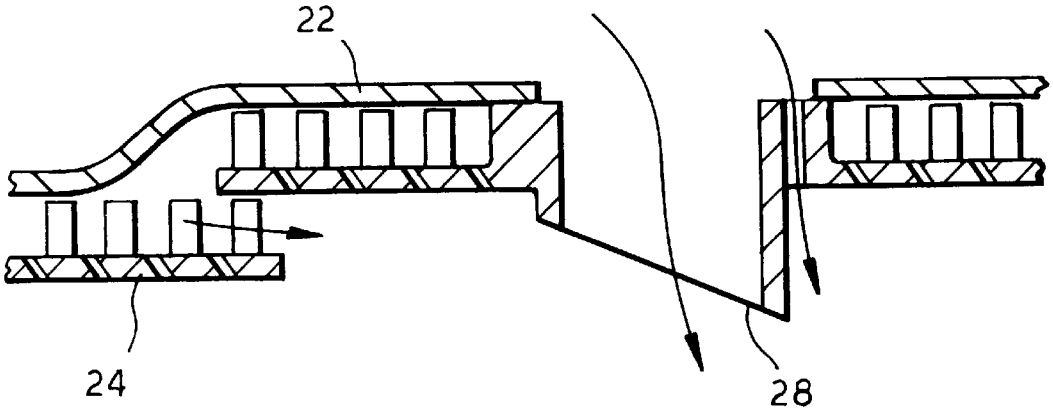
FIG. 4 is a detail close-up of part of the combustor wall incorporating chuted mixing ports in accordance with an embodiment of the invention.

The mixing ports 28 may be of a chuted design as shown in FIG. 4 or a conventional design as shown in FIG. 2.

This particular design of having chuted mixing ports 28 shields the jet of air from the upstream wall cooling film. The depth of the chute 28 is approximately 10 to 15 mm. The chuted design also advantageously allows control of the subsequent trajectory of the jet of air therefrom.

Figure 5:
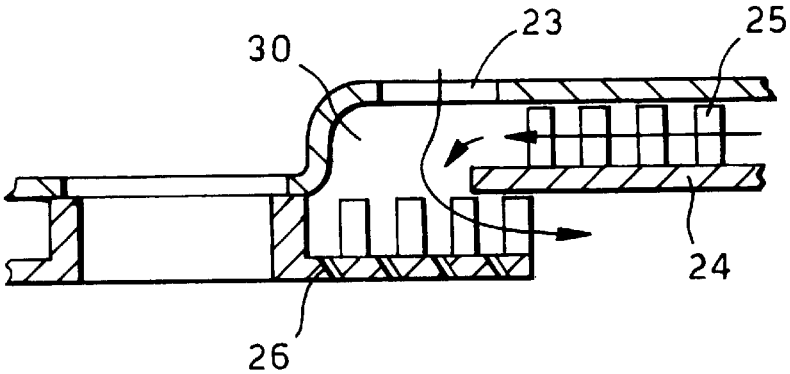
FIG. 5 is a detail close-up of part of a combustor wall in accordance with another embodiment of the invention.

In another embodiment of the invention feed holes 23 are located radially outboard from the angled cooling holes 26. Reference is directed to FIG. 5. A cooling air plenum 30 is formed between the tiles. The direction of air flow is indicated by arrows. Therefore, some of the inlet velocity of the cooling air is lost before air enters the effusion holes and the cooling air flow rate is reduced. Thus fewer larger feed holes 23 are used since the effect of the pedestal or land blockage does not need to be considered. This arrangement permits a single row of feed holes 23 (rather than two) where space is restricted.

The walls 21 of the tiles 24 may also be provided with a thermal barrier coating to provide additional thermal protection of the walls 21. In particular the downstream edges where there tends to be most heating of the tiles 24 may have a thermal barrier coating.

We claim:

1. A wall structure for a gas turbine engine combustor which at least in part defines a combustion chamber, the wall structure comprising at least one outer wall and one inner wall which are spaced apart to define a space therebetween, the outer wall having a means for the ingress of air into the space between the outer and inner walls, the inner wall comprising a number of wall elements, each of said wall elements having a plurality of inclined apertures defined therein to facilitate the exhaustion of air into the combustion chamber, each wall element also comprising a plurality of raised lands, the raised lands arranged in staggered rows so that the lands of adjacent rows are offset from one another and the inclined apertures are disposed between the raised lands, the arrangement of the raised lands providing in particular directions unobstructed channels between the raised lands, and the inclined apertures being orientated such that the axes of the inclined apertures lie along the unobstructed channels between the raised lands.

2. A wall structure for a gas turbine engine combustor which at least in part defines a combustion chamber which has a central axis, the wall structure comprising at least one outer wall and one inner wall which are spaced apart to define a space therebetween, the outer wall having a means for the ingress of air into the space between the outer and inner walls, the inner wall comprising a number of wall elements, each of said wall elements having a plurality of inclined apertures defined therein to facilitate the exhaustion of air into the combustion chamber, each wall element also comprising a plurality of raised lands, the raised lands arranged in staggered rows so that the lands of adjacent rows are offset from one another, and the inclined apertures each of which have an axis are orientated such that the angle defined between the aperture axis and the combustion chamber axis corresponds to an angular offset of the raised lands of adjacent rows.

3. A wall structure according to claim 1 or 2 wherein said lands are arranged in an array, and the offset of the lands of adjacent rows is at an angle to a central axis of the combustor.

4. A wall structure according to claim 1 wherein said combustor is arranged to have a general direction of fluid flow therethrough and said apertures are angled at an angle of 30° to the general direction of fluid flow with the combustion chamber as well as at an angle to the axis of the combustion chamber.

5. A wall structure according to claim 1 or 2 wherein said wall elements comprise discrete tiles.

6. A wall structure according to claim 1 or 2 wherein said raised lands comprise pedestals.

7. A wall structure according to claim 1 or 2 wherein mixing ports are provided within the combustion chamber walls to provide air into the combustion chamber.

8. A wall structure according to claim 1 or 2 wherein the downstream edges of each of the wall elements are coated with a thermal barrier coating.

* * * * *